United States Patent [19]

Thygesen

[11] Patent Number: 4,729,131

[45] Date of Patent: Mar. 8, 1988

[54] PANTY BRIEF AND A METHOD OF MAKING SAME

[75] Inventor: Eskild G. Thygesen, Ikast, Denmark

[73] Assignee: A/S Tytex, Ikast, Denmark

[21] Appl. No.: 805,344

[22] Filed: Dec. 4, 1985

[30] Foreign Application Priority Data

Dec. 5, 1984 [DK] Denmark ..... 5798/84

[51] Int. Cl.[4] ..... A41B 9/00

[52] U.S. Cl. ..... 2/400; 66/177

[58] Field of Search ..... 2/400, 401, 402, 404, 2/407; 66/177, 175

[56] References Cited

U.S. PATENT DOCUMENTS

| | | | |
|---|---|---|---|
| 2,469,134 | 5/1949 | Seiler | 66/177 |
| 3,656,323 | 4/1972 | Brown | 66/177 |
| 3,673,820 | 7/1972 | Sarmiento | 66/177 |
| 3,899,900 | 8/1975 | Jackson . | |
| 3,928,989 | 12/1975 | Giberstein | 66/177 |
| 3,946,579 | 3/1976 | Heinig | 66/177 |
| 4,390,999 | 7/1983 | Lawson et al. | 66/177 X |

FOREIGN PATENT DOCUMENTS

| | | | |
|---|---|---|---|
| 0122624 | 10/1984 | European Pat. Off. | 66/177 |

OTHER PUBLICATIONS

*Knitting Times*, "New Methods for Producing Pantyhose", pp. 56–60, vol. 48, No. 11, 3–1977.

*Primary Examiner*—Louis K. Rimrodt
*Assistant Examiner*—J. L. Olds
*Attorney, Agent, or Firm*—Frost & Jacobs

[57] ABSTRACT

A panty brief consists wholly or partly of elastic textile material, preferably made by knitting or crocheting, and is formed as a flat, substantially rectangular bag which is closed along three marginal zones. The bag is open in the whole extension of one longitudinal edge to provide a waist opening at the non-connected marginal zones, and is provided with two leg openings.

To produce such a panty brief, having inclined leg openings and a good fit, without any form of after-fashioning, inexpensively and by automatic machines, the leg openings are located opposite one another in the two side of the bag in a position between the marginal zone and the opposite marginal zone so that two of the interconnected marginal zones are placed in the front and the back of the panty brief, while the third is located in the crotch region of the panty brief between the leg openings.

9 Claims, 5 Drawing Figures

PANTY BRIEF AND A METHOD OF MAKING SAME

BACKGROUND OF THE INVENTION

This invention relates to a panty brief consisting wholly or partly of elastic material, preferably made by knitting or crocheting, formed as a flat, substantially rectangular bag, which is closed along three marginal zones and is open in the whole extension of one longitudinal edge to form a waist opening, the bag being provided with two leg openings.

It is known to produce panty briefs, e.g. by knitting, with varying tightness of the stitches in larger or smaller areas, and wtih knitted-in elastic yarn materials. It is also known to produce panty briefs with waist and leg openings in one and the same operation. Furthermore it is known to produce such panty briefs as tubular units in endless lengths, which are subsequently severed to obtain the final product in the form of a panty brief which does not require any finishing steps in the form of cutting, edging, seaming, etc.

These panty briefs are very cheap to manufacture as compared to the conventional factory-tailored panty briefs which are cut, edged and seamed, but they have several drawbacks.

One substantial drawback of these products is that the leg openings are not made in a bias-cut fashion corresponding to that of factory-tailored products. These products are made in the form of a front and a back piece which are inter-knitted along the sides and in the crotch region of the panty brief. Owing to this procedure, the crotch region will take an inconvenient fashion with a transversely extending seam or selvage. As a consequence of the straight leg opening, the outer portions of the panty brief will extend a considerable distance down along the outer side of the thighs of the wearer and will so to speak form short legs of the panty brief. These panty legs tend to restrain the freedom of movement of the hip joints, because they do not follow the natural shape of the legs. It has been attempted to remedy this drawback by cutting and edge-seaming of the leg openings after the panty briefs have been severed from the endless length. Hereby the bias-cut fashion is obtained, but the additional operations referred to result in a substantial increase of the production costs.

SUMMARY OF THE INVENTION

It is the object of the invention to remedy the above mentioned drawbacks and to provide a panty brief of the type referred to in the introductory clause of claim 1, which can be produced in endless lengths by automatic machines, and which is cheap to manufacture and has inclined leg openings and a good fit without any after-fashioning.

According to the invention, in order to achieve these objects, the leg openings are located opposite one another in the two sides of the bag in a position between the marginal zone adjoining the waist opening and the opposite marginal zone forming the crotch region of the panty brief.

Hereby it becomes possible in a surprisingly simple manner to make a panty brief having a body fit up to the standard of tailoring.

Another important advantage of the panty brief according to the invention is that by displacing the leg openings relatively to the vertical middle axis of the side of the bag the front and back pieces can be made nonsymmetrical so as to present a satisfactory fashion matching the front and back areas of the body.

An important field of use of panty briefs made wholly or partly from elastic materials is for the holding of diapers. The panty briefs are used both for children and for adults who are incontinent. Especially for adults it is of great importance that the diaper should be held in a secure manner so that there is no risk of leakage. Panty briefs of the above described type are known, in which areas of different elasticity are distributed in such a manner as to obtain a higher pressure against the marginal area of the diaper than against its central area. In these panty briefs the problem of the straight cut leg openings has not been solved. They therefore do not offer full wearing comfort to the user. Moreover, these panty briefs have an inconvenient transverse seam or selvage in the crotch region, as explained above. This transverse seam or selvage, which extends across the crotch region of the panty brief, will also extend across the central area of the diaper and will therefore counteract the intended distribution of pressure on the diaper, so that there will be a risk of leakage at the points of junction of the seam or selvage and the leg openings. This risk is particularly great when the said points are present immediately adjacent the lowermost area of the diaper, which will precisely be present in the crotch region of the panty brief when the wearer is in upright position.

It is a further advantage of the invention that it becomes possible to provide a panty brief of the type referred to having an adaptation of fashion such that it can be used for the holding of diapers, sanitary towels and the like.

To take the panty brief into use, all the user has to do is to grip each side of the bag in the middle of the marginal zone adjoining the waist opening and to spread out the two sides of the bag, which in the product as delivered by the machine are superposed in a substantially plane configuration. Hereby the panty brief is caused to assume its spatial configuration, the two sides of the bag forming a virtually tubular structure which is closed at one end by the interconnection of the marginal zones of the sides of the bag remote from the waist opening. This interconnection extends longitudinally through the crotch region, and the interconnections of the other two interconnected marginal zones extend upwards substantially in the middle of the front and back pieces of the panty brief. When the two sides of the bag are spread out in the manner described, the upper contour line of each leg opening will be pulled out to a greater distance from the middle than the lower contour line of the leg opening, because the movement of the latter contour line is restrained by the interconnection of the two sides of the bag extending longitudinally through the crotch region. Thereby the leg openings of the panty brief are caused to assume an inclined configuration, as viewed from in front or from behind.

In a preferred embodiment of the invention, the leg openings are displaced relatively to the vertical middle axis of the sides of the bag, thereby to provide an adaptation to the front and back areas of the body. By a displacement of suitable size of the leg openings, a panty brief is obtained, the front piece of which is smaller than its back piece, so that a fashion is obtained, that matches well with the front and back areas of the body and is substantially improved in comparison with the known panty briefs which are made with symmetrical front and back pieces.

In a further embodiment of the invention, the panty brief comprises knitted-in elastic yarns so placed as to create an inherent contraction, particularly at the ends of the sides of the bag adjacent to the connection between the marginal zones remote from the waist opening. Hereby a panty brief is obtained, in which the interknitted corners, which are located in front of and behind the crotch region, are converted to an approximately arcuate transition between the adjoining marginal zones, whereby only a very slight bulging of the panty brief material, if any at all, will occur when the panty brief is stretched on a user. Owing to the contraction of the material at the ends of the sides of the bag, the panty brief will assume an approximatively boat-shaped or banana-shaped configuration in the portion comprising the crotch region and extending somewhat upwards in both the front and back areas of the panty brief. The structural design of the panty brief, with the interconnection of the sides of the bag extending longitudinally through the crotch region, will have the effect that a corner zone is produced where a reduced pressure is exerted against the user, even if no bulging occurs. This makes the panty brief particularly suitable as a mens' panty brief, because the genitalia will not be pressed against the body. This form of panty brief will also be suitable for woman to hold a sanitary towel in place, because such a towel will not be pressed unnecessarily hard against the body of the user. The boat shape of the crotch region will support the sanitary towel in a soft arcuate shape along the crotch of the user, and moreover the towel can be held at a greater pressure along the marginal zones by the provision of elastic threads in the marginal zones of the leg openings.

A further advantageous feature is characterized in that the leg openings are provided at a suitable mutual distance to form a relatively wide crotch region, that the central portion of the crotch region has a looser structure, and that elastic threads running substantially parallel to the waist opening are incorporated in several positions at suitably selected distances from the marginal zone adjoining the waist opening.

A panty brief made in this way will further the advantages obtained by the panty brief described immediately above, and also makes it possible to form the crotch region in a size such as to make the panty brief particularly suitable for the holding of diapers for incontinent adults, seeing that the boat shape of the crotch region, the orientation of the interconnection of the two sides of the bag longitudinally of the crotch, in combination with the incorporated elastic threads, provide a particularly efficient support of a diaper where the risk of leakage along the marginal zones is minimized. Since the interconnection of the two sides of the bag extending longitudinally of the diaper will, owing to contraction in the corner zone, assume a boat shape, the interconnection will exert a smaller pressure against the central portion of the diaper, which will therefore be downwardly directed, so that the diaper will have a substantially V-shaped cross section, as viewed from in front or from behind. Body fluids will therefore tend to collect at the bottom of the V. This, in combination with the incorporated elastic threads supporting the marginal zone of the diaper, will afford an optimum security against leakage from the marginal zone.

In accordance with a further feature the panty brief is characterized in that it comprises zones of different knitting type both in the longitudinal and the transverse direction of the sides of the bag. Hereby a panty brief is provided which has a particularly good fit, and which can be produced on conventional knitting machines at the same speed and with the same production costs as known panty briefs made with straight leg openings.

According to a further feature, the panty brief is characterized in that the leg opening is elongated and extends substantially parallel to the marginal zone adjoining the waist opening. Hereby a panty brief is obtained having a leg opening that lends itself particularly well to production by automatic machines.

According to a further feature, the panty brief is characterized in that it is provided with a fly opening which is preferably placed asymmetrically with respect to a vertical middle plane through the front and back pieces of the panty brief. Hereby the panty brief, for use as a mens' panty brief, will also satisfy the users who traditionally want a panty brief with this facility.

The invention also relates to a method of making panty briefs consisting wholly or partly of elastic material, preferably by knitting or crocheting, each panty brief being formed as a flat, substantially rectangular bag, which is closed along three marginal zones and is open in the whole extension of one longitudinal edge to form a waist opening, the bag being provided with two leg openings.

This method is characterized in that the two superposed sides of the bag are interconnected along three marginal zones, and that a leg opening is produced in each side of the bag opposite one another, in a position between the marginal zone adjoining the waist opening and the opposite marginal zone forming the crotch region of the panty brief. Hereby a panty brief is obtained which can be manufactured by automatic machines, and which at the same time has a good fit without any after-fashioning steps.

The panty brief may in accordance with a preferred method be produced in endless lengths of two superposed continuous elastic webs, which at mutually spaced intervals are interconnected in the transverse direction of the webs, and are interconnected, e.g. by inter-knitting, along one marginal zone forming the crotch region of the panty brief, thereby to form a series of successive tubular units extending transversely of the webs and being closed at one end and open at the other, a leg opening being formed in each section between the transversely extending interconnections, and the webs being severed in the transversely extending interconnections to produce separate panty briefs. The continuous webs provide the side pieces of the panty brief, as contrasted to previous methods where the webs provided the front and back pieces of the panty brief. Hereby a surprisingly good fit of the panty brief is obtained.

The superposed webs may be produced in a width corresponding to a multiple of the height of the panty brief from the waist opening to the crotch portion. In that case the webs are interconnected in the longitudinal direction to form an interconnection substantially corresponding to that provided in the transverse direction so that the multiple web may subsequently be subdivided into webs having a width corresponding to the height of the panty brief. Alternatively, the webs may from the start be produced in a width corresponding to the height of the panty brief. In either case, the superposed webs when leaving the machine, are interconnected along one of their marginal zones and open along the opposite marginal zone, at which the waist opening is formed, so that the individual panty briefs are formed by subsequent cutting along the transverse interconnections.

Since the panty brief as above described can be used for both adults and children, it is advantageous to provide the panty brief with a colour code indicative of the size. It then becomes easier to select a panty brief of suitable size, which may particularly be useful in institutions where the panty briefs are held in stock in many different sizes. It is observed, however, that the panty brief can also be made as a one-size article having an elasticity such that it can be expanded to several times its as-made size by stretching without loosing its characteristics and fit, so that it can fit persons of rather different individual sizes.

A panty brief according to the invention can also be made in the form of a tanga brief with elongated leg openings longitudinally extending substantially parallel to the marginal zone adjoining the waist opening and with the intermediate portion between the leg openings and the waist opening mainly in the form of a band constituting the border of the panty brief.

The two sides of the bag forming the panty brief can be formed either from a textile material sheet made in one piece, from two textile material sheets each forming a side of the bag, or from any number of individually produced textile material sheets, which are interconnected so as to form a bag. The only requirement is that a bag having two sides is produced, and that a leg opening is formed in each side of this bag.

Thus, the two sides of the bag may be formed by the folding of a textile material sheet made in one piece and provided with leg openings on each side of the folding line, the area of the textile material located between the leg openings and extending around the folding line forming the crotch region. In this case interconnection of the sides of the bag will be formed by the continuity of the textile material, and there will be no seam or selvage in the crotch region.

The bag can also be made by the interconnection of three individually produced textile material sheets, of which one, forming the lower portion of both sides of the bag, is interconnected with the upper portion of each side of the bag only along part of the length of the bag, thereby to produce the leg openings in the non-interconnected zones. In this panty brief, the interconnection of the sides of the bag will be constituted by a folding line in the textile material sheet forming the lower portion of both sides of the bag, and thus there will be no seam or selvage in the crotch region in this case either.

A material which is frequently used for the production of panty briefs is cotton, and though not expressly specified in the above description, it is to be understood that the panty brief according to the invention can be made predominantly from a material, such as cotton which is knitted or woven in a manner well known in the art such as to provide an inherent elastic effect, and can be provided with suitably incorporated elastic threads for creating an enhanced elastic effect along the waist and leg openings, such as is well known in the art. This just means that it is necessary to produce the panty brief in different sizes to match with the individual sizes of different persons.

DESCRIPTION OF THE PREFERRED EMBODIMENT

Figure 1:
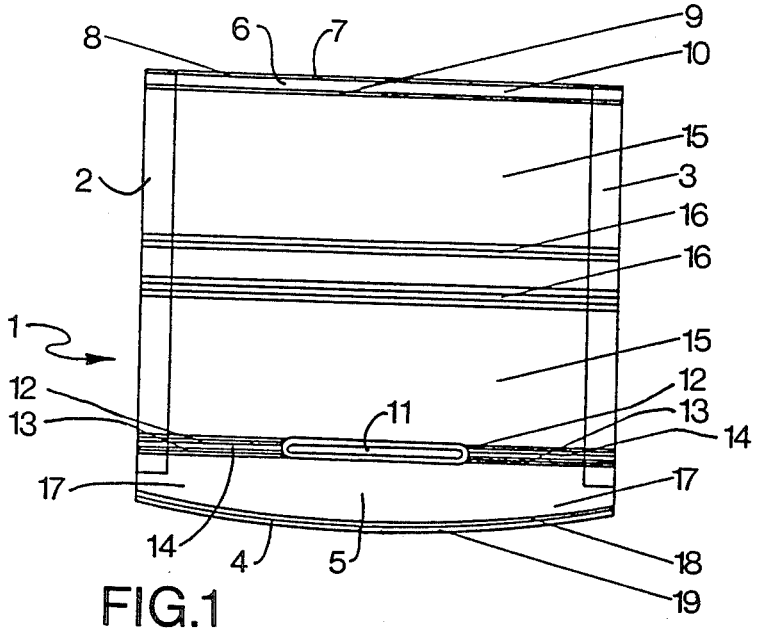
FIG. 1 is a diagrammatic illustration of a side of a bag forming a panty brief according to the invention.
Figure 5:
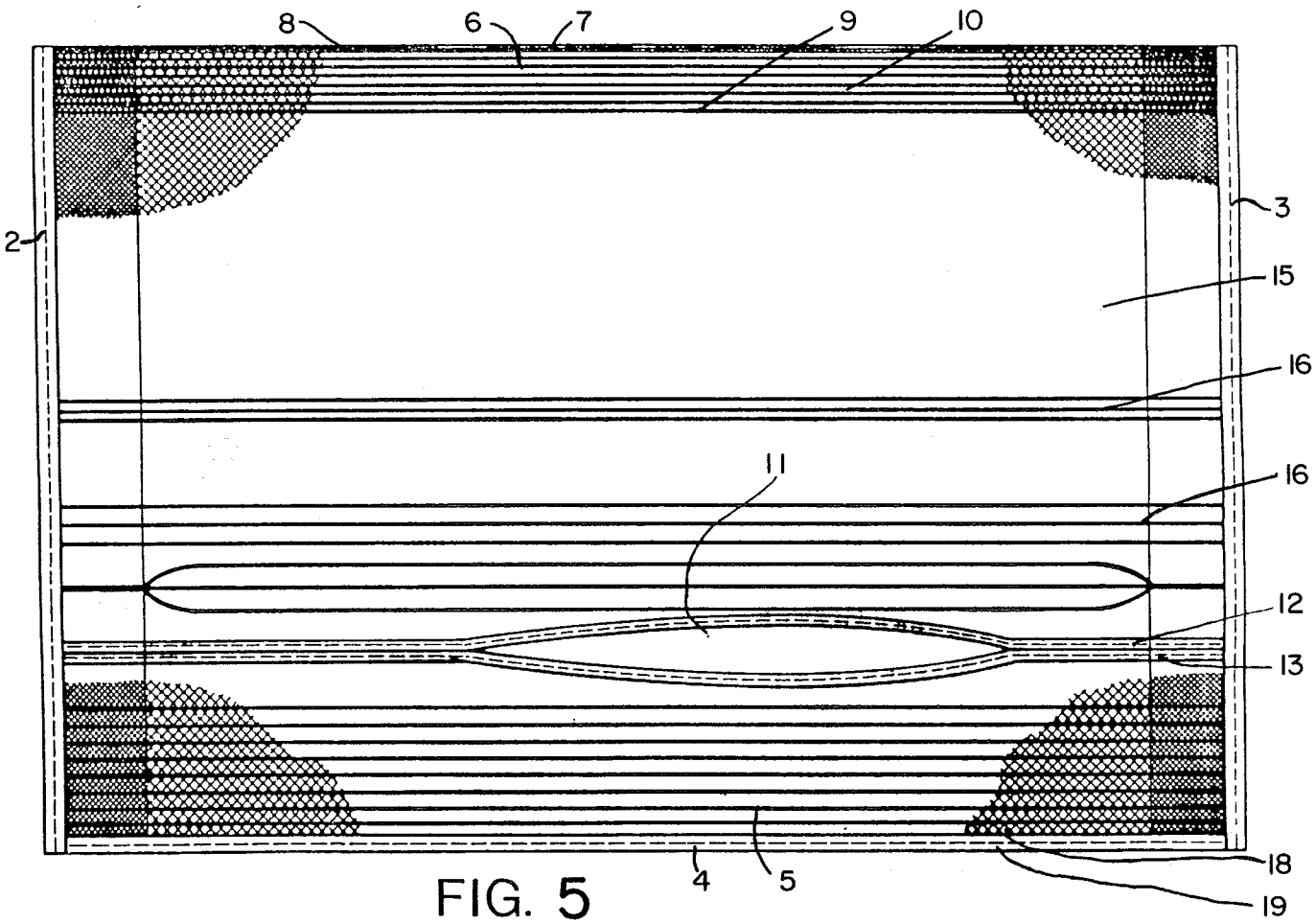
FIG. 5 is a modification of the embodiment of FIG. 1, showing a displacement of the leg openings longitudinally relative to the transverse middle axis of the bag.

FIG. 1 shows a substantially rectangular side 1 of a bag forming a panty brief according to the invention, which in marginal zones 2,3 is interconnected with a superposed substantially identical side of a bag (not shown). The side of a bag shown has been produced on a conventional knitting machine. The sides of the bag are moreover interconnected along a marginal zone 4 provided in the crotch region 5 of the panty brief. The waist opening 7 of the panty brief is formed between the non-interconnected marginal zones 6, which are provided with suitably selected elastic threads 8, 9 which create an elastic band 10 well known in the art. The side of the bag shown has an elongated leg opening 11 extending substantially parallel to the marginal zone 6 adjoining the waist opening, such as seen in the plane configuration of FIG. 1. The opening is shown as being placed in the middle of the side 1 of the bag, but will preferably be displaced in a direction parallel to the waist opening so as to obtain an adaptation to the front area and the back area respectively of the body of the user, seeing that a displacement of the leg openings will change the size relation between the front piece and the back piece of the panty brief, as shown in FIG. 5.

In order to form elastic leg openings, upper and lower elastic threads 12, 13 are knitted-in, which are interconnected in zones 14 extending from the marginal zones 2, 3 to the leg openings 11, which owing to the different knitting types take the form of an elastic and wear-proof comfortable border. By varying the number, type and size of stitches and the dimension and type of yarn in the upper and lower threads 12, 13, a remarkable possibility of fashioning the leg openings 11 in the finished product is obtained. It thereby becomes possible to obtain a good match with the shape of the body. E.g. the upper border or contour line can be knitted with one or more pre-tensioned elastic threads, seeing that the pre-tension will yield a contour line with greater height of curvature, whereby a larger leg opening is obtained. The lower border or contour line of the leg opening 11 can be similarly fashioned.

Figure 2:
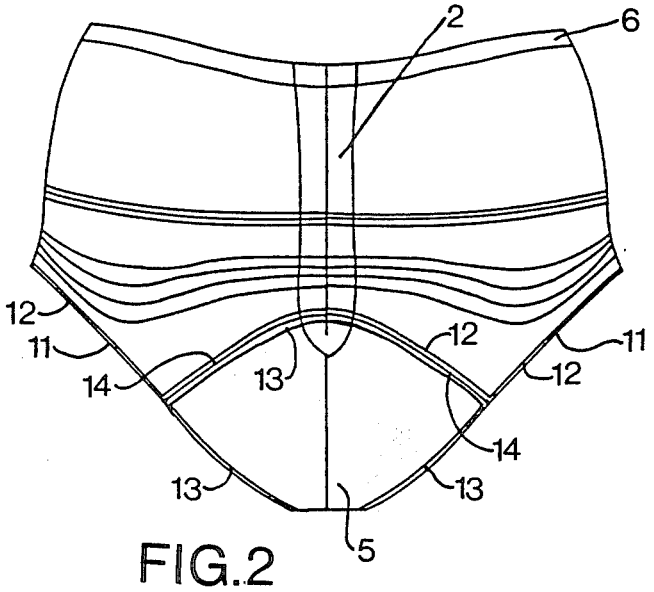
FIG. 2 is a diagrammatic illustration of a panty brief made from a bag having sides as illustrated in FIG. 1, as seen from in front in an unfolded state.

By varying the width of the crotch region 5 between the leg openings of the panty brief, see FIG. 2, a further individual adaptation to the body can be obtained. Moreover, the panty brief is provided, in a substantially tubular portion 15 serving to surround the human torso, with additional elastic knitted-in bands 16 in order to produce a good fit. The basic material of the panty brief itself consists preferably of stretchable material with different degrees of stretchability in order to adapt itself to the shape of the body.

The panty brief can e.g. be provided in the border 10 with a knitted-in colour code indicative of size. The panty brief can also be a one-size article without colour code.

As is apparent from FIG. 1, the marginal zone 4 is slightly arcuate. This arcuate shape has been obtained by knitting the panty brief more tightly at the outer ends and more loosely in the middle zone and with use of elastic yarns placed in such a manner that an inherent contraction is produced at the outer ends 17 of the side of the bag adjacent the lower corners, such as seen in FIG. 1. The arcuate shape contributes to the achievement of an improved adaptation to the body. In the marginal zone 4, elastic threads 18, 19 are knitted in.

When the panty brief is to be taken into use, it is unfolded as above described, the user gripping the border 10 approximately in the middle between the marginal zones 2, 3 and spreading out the border 10 in order to form the waist opening 7. Hereby the panty brief assumes the shape of a spatial object, in which the interconnected marginal zones 2 of the sides of the bag are located in front and the interconnected marginal zones 3 are located in the back of the panty brief. By this unfolding the leg openings 11 automatically assume an inclined shape as previously explained.

In FIG. 2, the panty brief 1 is seen in its unfolded state, where the inclined fashion of the leg openings 11 is clearly apparent. This fashion has been obtained without any form of after-fashioning by the mere act of unfolding the panty brief as produced in one operation.

Figure 3:
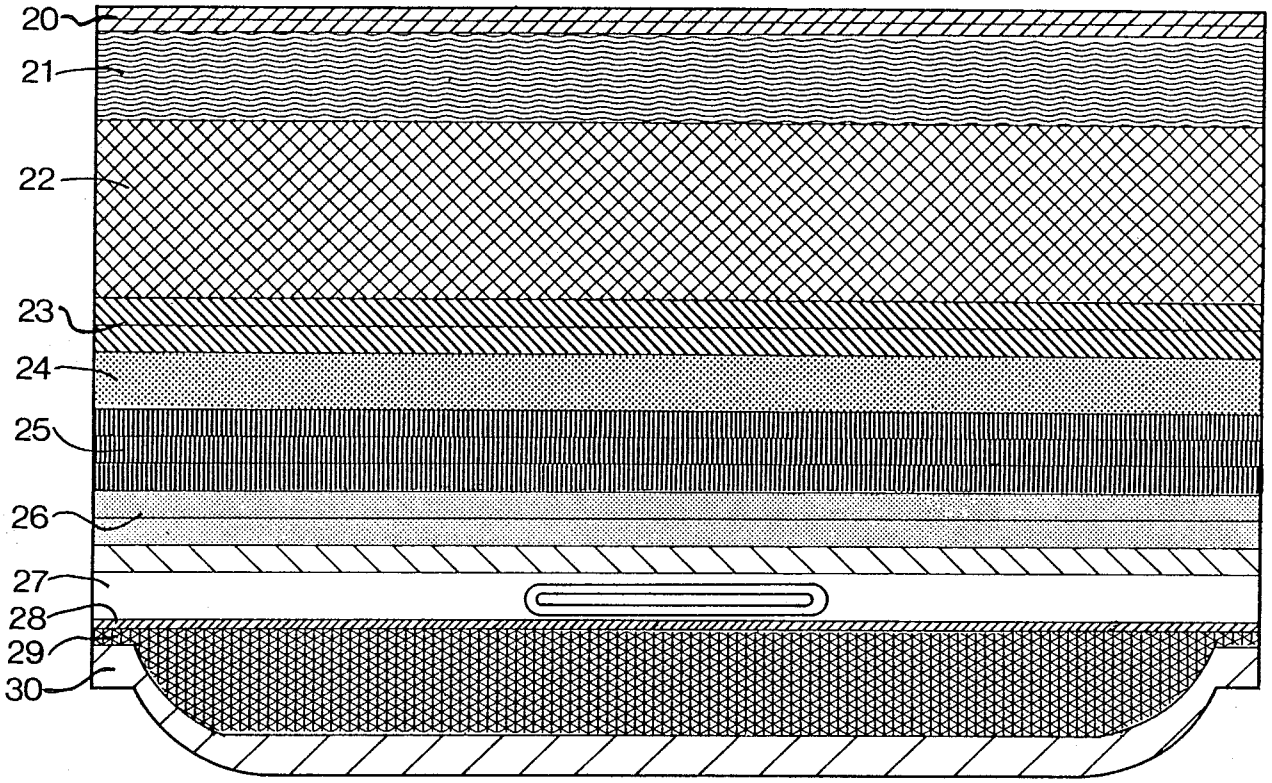
FIG. 3 is a diagrammatic illustration of a side of a bag forming a panty brief according to the invention for illustrating the various knitting types from top to bottom.
Figure 4:
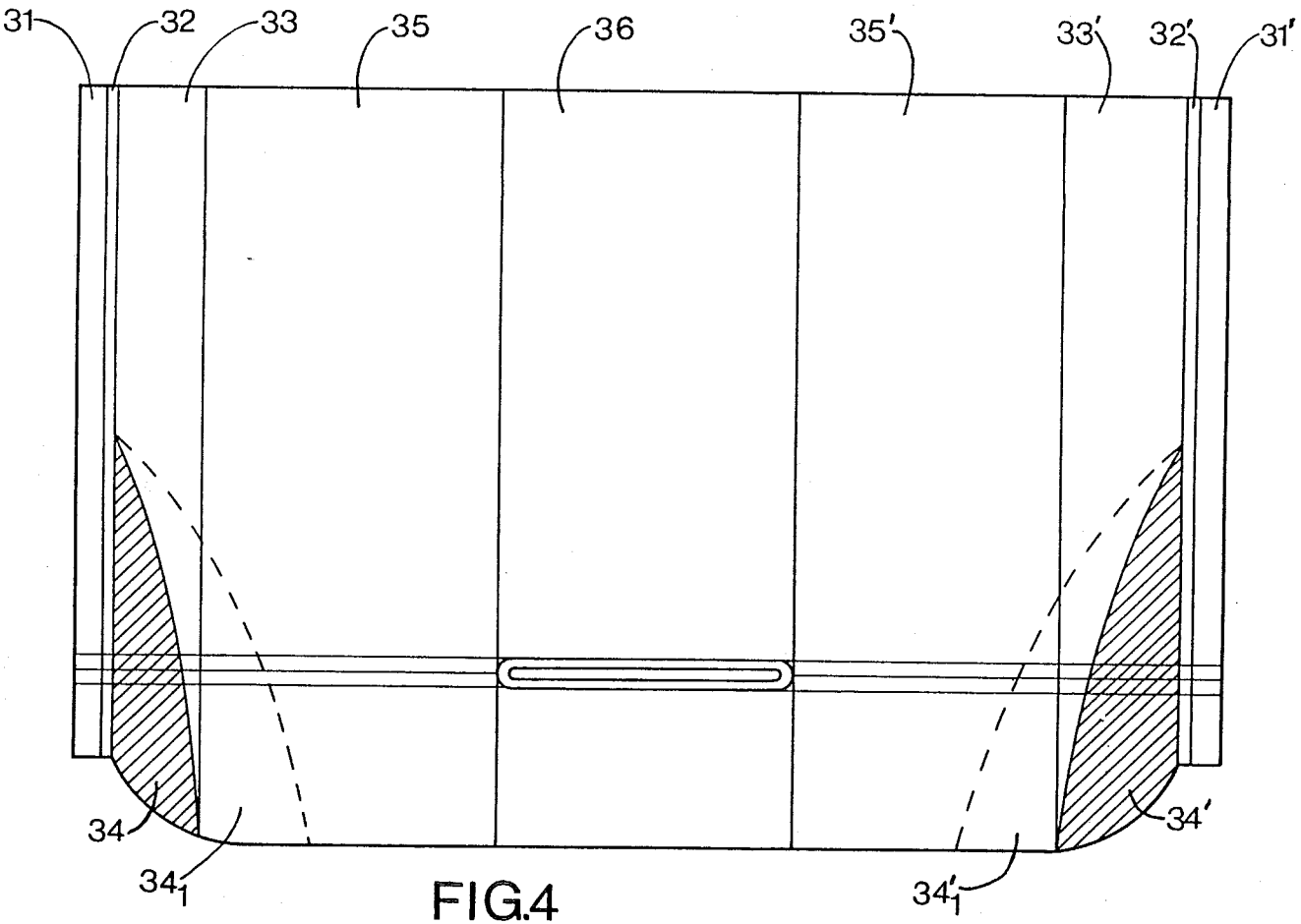
FIG. 4 is a diagrammatic illustration of a side of a bag, such as shown in FIG. 3, but for illustrating the various knitting types in the longitudinal direction of the side of the bag.

FIGS. 3 and 4 show the placing and distribution of zones of different structure (type, size and number of stitches and type and dimension of yarn) in a side of a bag forming a panty brief for holding a diaper in place. It will be seen that different knitting types and yarn materials of known type are used for the sides of the bag forming the panty brief, as illustrated in FIGS. 3 and 4. Polyamide, polyester and cotton threads may be used for knit or crocheted zones and for netting, while spandex (e.g., sold under the registered trademark "Lycra") may be used as elastic threads. The knitting may be done on a double needle bar, warp knitting machine, of the Raschel type, to produce knit structures of the type disclosed in U.S. Pat. No. 3,899,900 issued Aug. 19, 1975 to G. E. Jackson. As indicated above the yarn materials and knit structures are known in the art and can be readily adapted for use in the present invention by those skilled in the art.

The side of the bag comprises:

a zone 20 which is knitted to prevent rolling-up of the edge and comprising elastic threads and, if desired, a colour code indicative of the size of the panty brief, a zone 21 with a knitting type substantially corresponding to that of the zone 20 and forming an elastic band or border, a zone 22 of normal run-proof and airy netting made from the material which is most suitable for the intended use of the garment, a zone 23 with elastic threads primarily serving to support the panty brief and a diaper placed therein, a zone 24 which may be identical to the zone 22, a zone 25 comprising elastic threads and serving to hold a diaper in place, a zone 26 with the same function as the zone 25, but with elastic threads knitted in on the rear side to contribute to the contraction of the marginal zone, a zone 27 consisting of upper and lower elastic threads which can be knitted with varying stitch tightness and selection of thread in order to modify the fit of the leg opening provided therein, a zone 28 comprising elastic threads and contributing to improve the fit of the leg opening by the use of tighter or looser knitting, a zone 29 where elastic threads are arranged alternately on the rear side and the front side to produce the contraction of the lower corner areas 17, and a zone 30 comprising an interknitting with slight overlap of the two sides of the bag so that only a marking of the joint is produced.

In FIG. 4, the vertical zones are marked. These comprise:

a zone 31, which is part of an interknitting intended for severing, a zone 32, which is tightly knitted and relatively non-elastic and contributes to reinforce the middle zone on the front and back. This zone 32 is less elastic than the adjoining zone 33 and therefore contributes to form the boat shape.

A zone 33 with tight and relatively stiff knitting, a zone 34 constituting the lower portion of the zone 33 and showing a tight knitting, which furthers the contraction and makes the tip of the corner as small as possible. This zone $34_1$ can also extend into a zone 35, a zone 35 with a knitting such as mentioned for the zone 22, and a zone 36 which substantially corresponds to the zone 35, but contains the leg openings.

The position of the zone 36 in the zone 35 can be displaced in order to produce different front and back sides of the panty brief.

The zones indicated by a prime are zones, which are substantially identical to zones having the same reference characters without a prime.

I claim:

1. A panty brief comprised at least in part of elastic material, made by at least one of knitting and crocheting formed as a flat, substantially rectagular bag composed of two superposed webs which provide side pieces of said panty brief, said bag being closed along three marginal edge zones and being open in the whole extension of one longitudinal edge to form a waist opening, the bag being provided with two elongated leg openings, wherein said leg openings are located opposite one another in said two side pieces of the bag in a position between and parallel to a longitudinal marginal zone adjoining said waist opening and an opposite longitudinal marginal zone forming a crotch region of the panty brief.

2. A panty brief according to claim 1, wherein each of said leg openings is displaced longitudinally relatively to the transverse middle axis of the side of the leg, thereby to provide an adaptation to the front and back areas of the body.

3. A panty brief according to claim 1, wherein it comprises knitted-in elastic yarns so placed as to create an inherent contraction, particularly at the ends of the sides of the bag adjacent to the connection between said opposite longitudinal marginal zone and a transverse zone remote from the waist opening.

4. A panty brief according to claim 1, wherein the leg openings are provided at a suitable mutual distance from said opposite longitudinal marginal zone to form a relatively wide crotch region, the central crotch region has a looser structure than that of the outer ends thereof, and elastic threads running substantially parallel to the waist opening are incorporated in several positions at suitably selected distances from the marginal zone adjoining the waist opening.

5. A panty brief according to claim 1, wherein it comprises zones of different knitting type both in the longitudinal and the transverse direction of the side of the bag.

6. A panty brief according to claim 1, wherein it is provided with a fly opening which is preferably placed asymmetrically with respect to a vertical middle plane through the front and back pieces of the panty brief.

7. A method of making panty briefs comprised at least in part of elastic material by at least one of knitting and crocheting, comprising the steps of:

forming two substantially rectangular sheets each of which is provided with an opening intended to form a leg opening positioned between a marginal edge zone intended to form a waist opening and an opposite marginal zone forming a crotch region;

superposing said two sheets so that said openings are positioned opposite one another; and closing said two sheets along three marginal edge zones at two sides of said sheets and at said crotch region so as to form a flat substantially rectangular bag which is open at the remaining marginal edge to form said waist opening.

8. The method of claim 7, wherein said panty briefs are produced in endless lengths of two superposed webs which are interconnected at mutually spaced intervals in the transverse direction along said marginal zone forming said crotch region of each panty brief, wherein said leg opening is formed in each web between each transverse interconnection and substantially parallel thereto, and wherein said webs are severed along each said transverse interconnection to produce separate panty briefs.

9. The method of claim 7, wherein said panty briefs are knitted with elastic yarns which are positioned as to produce inherent contractions at the ends of said sides remote from said waist opening.

* * * * *